US008807389B2

(12) United States Patent
Meyer et al.

(10) Patent No.: US 8,807,389 B2
(45) Date of Patent: Aug. 19, 2014

(54) ITEM DISPENSING UNIT

(75) Inventors: William A. Meyer, Wexford, PA (US); Patrick J. Braun, Pittsburgh, PA (US)

(73) Assignee: Aesynt Incorporated

( * ) Notice: Subject to any disclaimer, the term of this patent is extended or adjusted under 35 U.S.C. 154(b) by 252 days.

(21) Appl. No.: 13/435,010

(22) Filed: Mar. 30, 2012

(65) Prior Publication Data

US 2013/0261791 A1 Oct. 3, 2013

(51) Int. Cl.
*G07F 11/00* (2006.01)
*G07F 11/04* (2006.01)
*G07F 11/16* (2006.01)

(52) U.S. Cl.
CPC ..... *G07F 11/165* (2013.01); *G07F 11/04* (2013.01)
USPC ..... 221/196; 221/256; 221/263

(58) Field of Classification Search
CPC ..... G07F 11/007; G07F 11/04; G07F 11/10; G07F 11/16; G07F 11/165; G07F 11/62; G07F 11/46; G07F 11/60; G07F 11/48; A47F 1/10; B65G 59/067
USPC ..... 221/270, 131, 196, 192, 195, 256, 263
See application file for complete search history.

(56) References Cited

U.S. PATENT DOCUMENTS 4,668,150 A * 5/1987 Blumberg ..... 221/195
4,717,042 A 1/1988 McLaughlin
4,785,969 A 11/1988 McLaughlin
4,847,764 A 7/1989 Halvorson
5,014,875 A 5/1991 McLaughlin et al.
5,065,897 A 11/1991 Smith
5,190,185 A 3/1993 Blechl
5,314,243 A 5/1994 McDonald et al.
5,346,297 A 9/1994 Colson, Jr. et al.
5,377,864 A 1/1995 Blechl et al.
5,405,048 A 4/1995 Rogers et al.
5,431,299 A 7/1995 Brewer et al.
5,460,294 A 10/1995 Williams (Continued)

FOREIGN PATENT DOCUMENTS

WO WO 84/03425 A1 9/1984
WO WO 2007/009714 A1 1/2007

OTHER PUBLICATIONS

International Searching Authority, International Search Report and Written Opinion for International Application No. PCT/US2013/030238, mailed Jul. 18, 2013, 10 pages, European Patent Office, The Netherlands.

*Primary Examiner* — Timothy Waggoner
(74) *Attorney, Agent, or Firm* — Alston & Bird LLP

(57) ABSTRACT

Systems, methods, apparatus, and computer program products are provided for dispensing items. In one embodiment, a magazine defining a channel adapted to store a plurality of items of substantially similar size in a uniform manner is provided. The magazine may also define (a) a rake element path adapted to allow one item of the plurality of items to be engaged and (b) a dispensing opening adapted to allow the engaged item to be urged out of the dispensing opening. In such an embodiment, a receptacle may also be provided. The receptacle may comprise a storage cavity and a rake element, wherein the rake element is adapted to (a) pass through the rake element path of the magazine to engage the item and (b) urge the item out of the dispensing opening of the magazine into the storage cavity of the receptacle.

17 Claims, 11 Drawing Sheets

(56) References Cited

U.S. PATENT DOCUMENTS

| | | | | |
|---|---|---|---|---|
| 5,468,110 | A | 11/1995 | McDonald et al. | |
| 5,480,062 | A | 1/1996 | Rogers et al. | |
| 5,520,450 | A | 5/1996 | Colson, Jr. et al. | |
| 5,564,803 | A | 10/1996 | McDonald et al. | |
| 5,593,267 | A | 1/1997 | McDonald et al. | |
| 5,661,978 | A | 9/1997 | Holmes et al. | |
| D384,578 | S | 10/1997 | Wangu et al. | |
| 5,713,485 | A | 2/1998 | Liff et al. | |
| 5,716,114 | A | 2/1998 | Holmes et al. | |
| 5,745,366 | A | 4/1998 | Higham et al. | |
| 5,761,877 | A | 6/1998 | Quandt | |
| 5,797,515 | A | 8/1998 | Liff et al. | |
| 5,805,456 | A | 9/1998 | Higham et al. | |
| 5,842,976 | A | 12/1998 | Williamson | |
| 5,878,885 | A | 3/1999 | Wangu et al. | |
| 5,880,443 | A | 3/1999 | McDonald et al. | |
| 5,883,806 | A | 3/1999 | Meador et al. | |
| 5,893,697 | A | 4/1999 | Zini et al. | |
| 5,905,653 | A | 5/1999 | Higham et al. | |
| 5,912,818 | A | 6/1999 | McGrady et al. | |
| 5,927,540 | A | 7/1999 | Godlewski | |
| 5,940,306 | A | 8/1999 | Gardner et al. | |
| 5,971,593 | A | 10/1999 | McGrady | |
| 6,003,006 | A | 12/1999 | Colella et al. | |
| 6,011,999 | A | 1/2000 | Holmes | |
| 6,021,392 | A | 2/2000 | Lester et al. | |
| 6,039,467 | A | 3/2000 | Holmes | |
| 6,065,819 | A | 5/2000 | Holmes et al. | |
| 6,068,156 | A | 5/2000 | Liff et al. | |
| 6,109,774 | A | 8/2000 | Holmes et al. | |
| 6,112,502 | A | 9/2000 | Frederick et al. | |
| 6,116,461 | A | 9/2000 | Broadfield et al. | |
| 6,151,536 | A | 11/2000 | Arnold et al. | |
| 6,170,230 | B1 | 1/2001 | Chudy et al. | |
| 6,176,392 | B1 | 1/2001 | William et al. | |
| 6,189,727 | B1 | 2/2001 | Shoenfeld | |
| 6,223,934 | B1 | 5/2001 | Shoenfeld | |
| 6,256,967 | B1 | 7/2001 | Hebron et al. | |
| 6,283,322 | B1 | 9/2001 | Liff et al. | |
| 6,289,656 | B1 | 9/2001 | Wangu et al. | |
| 6,338,007 | B1 | 1/2002 | Broadfield et al. | |
| 6,339,732 | B1 | 1/2002 | Phoon et al. | |
| 6,361,263 | B1 | 3/2002 | Dewey et al. | |
| 6,370,841 | B1 | 4/2002 | Chudy et al. | |
| 6,415,952 | B1 * | 7/2002 | Ohtuka et al. | 221/131 |
| 6,449,927 | B2 | 9/2002 | Hebron et al. | |
| 6,471,089 | B2 | 10/2002 | Liff et al. | |
| 6,497,342 | B2 | 12/2002 | Zhang et al. | |
| 6,499,270 | B2 | 12/2002 | Peroni et al. | |
| 6,532,399 | B2 | 3/2003 | Mase | |
| 6,564,121 | B1 | 5/2003 | Wallace et al. | |
| 6,581,798 | B2 | 6/2003 | Liff et al. | |
| 6,609,047 | B1 | 8/2003 | Lipps | |
| 6,611,733 | B1 | 8/2003 | De La Huerga | |
| 6,625,952 | B1 | 9/2003 | Chudy et al. | |
| 6,640,159 | B2 | 10/2003 | Holmes et al. | |
| 6,650,964 | B2 | 11/2003 | Spano, Jr. et al. | |
| 6,671,579 | B2 | 12/2003 | Spano, Jr. et al. | |
| 6,681,149 | B2 | 1/2004 | William et al. | |
| 6,682,289 | B1 * | 1/2004 | Credle, Jr. | 221/195 |
| 6,742,671 | B2 | 6/2004 | Hebron et al. | |
| 6,755,931 | B2 | 6/2004 | Vollm et al. | |
| 6,760,643 | B2 | 7/2004 | Lipps | |
| 6,776,304 | B2 | 8/2004 | Liff et al. | |
| 6,785,589 | B2 | 8/2004 | Eggenberger et al. | |
| 6,790,198 | B1 | 9/2004 | White et al. | |
| 6,814,254 | B2 | 11/2004 | Liff et al. | |
| 6,814,255 | B2 | 11/2004 | Liff et al. | |
| 6,847,861 | B2 | 1/2005 | Lunak et al. | |
| 6,874,684 | B1 | 4/2005 | Denenberg et al. | |
| 6,892,780 | B2 | 5/2005 | Vollm et al. | |
| 6,895,304 | B2 | 5/2005 | Spano, Jr. et al. | |
| 6,975,922 | B2 | 12/2005 | Duncan et al. | |
| 6,985,797 | B2 | 1/2006 | Spano, Jr. et al. | |
| 6,996,455 | B2 | 2/2006 | Eggenberger et al. | |
| 7,010,389 | B2 | 3/2006 | Lunak et al. | |
| 7,014,063 | B2 | 3/2006 | Shows et al. | |
| 7,016,766 | B2 | 3/2006 | William et al. | |
| 7,040,504 | B2 | 5/2006 | Broadfield et al. | |
| 7,052,097 | B2 | 5/2006 | Meek, Jr. et al. | |
| 7,072,737 | B2 | 7/2006 | Lunak et al. | |
| 7,072,855 | B1 | 7/2006 | Godlewski et al. | |
| 7,077,286 | B2 | 7/2006 | Shows et al. | |
| 7,085,621 | B2 | 8/2006 | Spano, Jr. et al. | |
| 7,092,796 | B2 | 8/2006 | Vanderveen | |
| 7,093,755 | B2 | 8/2006 | Jordan et al. | |
| 7,100,792 | B2 | 9/2006 | Hunter et al. | |
| 7,103,419 | B2 | 9/2006 | Engleson et al. | |
| 7,111,780 | B2 | 9/2006 | Broussard et al. | |
| 7,139,639 | B2 | 11/2006 | Broussard et al. | |
| 7,150,724 | B2 | 12/2006 | Morris et al. | |
| 7,171,277 | B2 | 1/2007 | Engleson et al. | |
| 7,218,231 | B2 | 5/2007 | Higham | |
| 7,228,198 | B2 | 6/2007 | Vollm et al. | |
| 7,249,688 | B2 | 7/2007 | Hunter et al. | |
| 7,348,884 | B2 | 3/2008 | Higham | |
| 7,417,729 | B2 | 8/2008 | Greenwald | |
| 7,419,133 | B2 | 9/2008 | Clarke et al. | |
| 7,426,425 | B2 | 9/2008 | Meek, Jr. et al. | |
| 7,554,449 | B2 | 6/2009 | Higham | |
| 7,571,024 | B2 | 8/2009 | Duncan et al. | |
| 7,588,167 | B2 | 9/2009 | Hunter et al. | |
| 8,251,254 | B2 * | 8/2012 | Guggenmos et al. | 221/270 |

* cited by examiner

ITEM DISPENSING UNIT

BACKGROUND

Dispensing units exist, for example, in healthcare facilities for storing and dispensing medications for patients. A need exists to provide for an automated dispensing unit that allows quick access to such items.

BRIEF SUMMARY

In general, embodiments of the present invention provide systems, methods, apparatus, and computer program products for dispensing items. For example, in one embodiment, a magazine may define a channel adapted to store a plurality of items of substantially similar size in a uniform manner. The magazine may also define a rake element path that is adapted to allow one item at a time to be engaged by a rake element to be urged out of a dispensing opening of the magazine. A receptacle comprising a storage cavity and a rake element can be adapted such that the rake element passes through the rake element path of the magazine to engage an item and urge the item out of the dispensing opening of the magazine and into the storage cavity of the receptacle.

In accordance with one aspect, an apparatus for dispensing items is provided. In one embodiment, the apparatus comprises a magazine comprising a front, a back, a first side, a second side, and a bottom, wherein (a) the front, the back, the first side, and the second side define a channel adapted to store a plurality of items of substantially similar size in a uniform manner, (b) the bottom defines a rake element path adapted to allow an item of the plurality of items in contact with the bottom to be engaged, and (c) the front defines a dispensing opening adapted to allow the engaged item to be urged out of the dispensing opening. The apparatus may also comprise a receptacle comprising a storage cavity and a rake element, wherein the rake element is adapted to (a) pass through the rake element path of the magazine to engage a first item of the plurality of items and (b) urge the first item out of the dispensing opening of the magazine into the storage cavity of the receptacle.

In accordance with another aspect, an apparatus for dispensing items is provided. In one embodiment, the apparatus comprises a plurality of magazines, wherein (a) each magazine comprises a front, a back, a first side, a second side, and a bottom, (b) the front, the back, the first side, and the second side of each magazine define a channel adapted to store a plurality of items of substantially similar size in a uniform manner, (b) the bottom of each magazine defines a rake element path adapted to allow an item of the plurality of items stored therein and in contact with the bottom to be engaged, and (c) the front of each magazine defines a dispensing opening adapted to allow the engaged item of each magazine to be urged out of the dispensing opening. The apparatus may also comprise a receptacle comprising a storage cavity and a rake element, wherein the rake element is adapted to (a) pass through the rake element path of a first magazine to engage a first item and (b) urge the first item out of the dispensing opening of the first magazine into the storage cavity of the receptacle.

In accordance with still another aspect, a method for dispensing items is provided. In one embodiment, the method comprises (1) receiving information of an item to be dispensed, wherein (a) the item is stored in a magazine defining a channel adapted to store a plurality of items of substantially similar size in a uniform manner, (b) the magazine defines a rake element path adapted to allow the item to be engaged, and (c) the magazine defines a dispensing opening adapted to allow the item to be urged out of the dispensing opening; (2) identifying the magazine storing the item; (3) causing the magazine to be moved from a non-dispensing position to a dispensing position; and (4) causing a receptacle to be moved from a non-collecting position through a collection movement, wherein (a) the receptacle comprises a storage cavity and a rake element, (b) via the collection movement the rake element passes through the rake element path of the magazine to engage the first item and urge the first item out of the dispensing opening of the magazine into the storage cavity of the receptacle.

In accordance with yet another aspect, a computer program product for dispensing items is provided. The computer program product may comprise at least one computer-readable storage medium having computer-readable program code portions stored therein, the computer-readable program code portions comprising executable portions configured to (1) receive information of an item to be dispensed, wherein (a) the item is stored in a magazine defining a channel adapted to store a plurality of items of substantially similar size in a uniform manner, (b) the magazine defines a rake element path adapted to allow the item to be engaged, and (c) the magazine defines a dispensing opening adapted to allow the item to be urged out of the dispensing opening; (2) identify the magazine storing the item; (3) cause the magazine to be moved from a non-dispensing position to a dispensing position; and (4) cause a receptacle to be moved from a non-collecting position through a collection movement, wherein (a) the receptacle comprises a storage cavity and a rake element, (b) via the collection movement the rake element passes through the rake element path of the magazine to engage the first item and urge the first item out of the dispensing opening of the magazine into the storage cavity of the receptacle.

BRIEF DESCRIPTION OF THE SEVERAL VIEWS OF THE DRAWING(S)

Reference will now be made to the accompanying drawings, which are not necessarily drawn to scale, and wherein.

FIGS. 3A, 3B, 3C, 3D, 3E, and 3F illustrate different perspectives of a unit dose package according to one embodiment of the present invention.

FIGS. 4A, 4B, 4C, 4D, 4E, and 4F illustrate different perspectives of a unit dose package according to one embodiment of the present invention.

FIGS. 5-8 illustrate different perspective views of a magazine according to one embodiment of the present invention.

Figure 9:
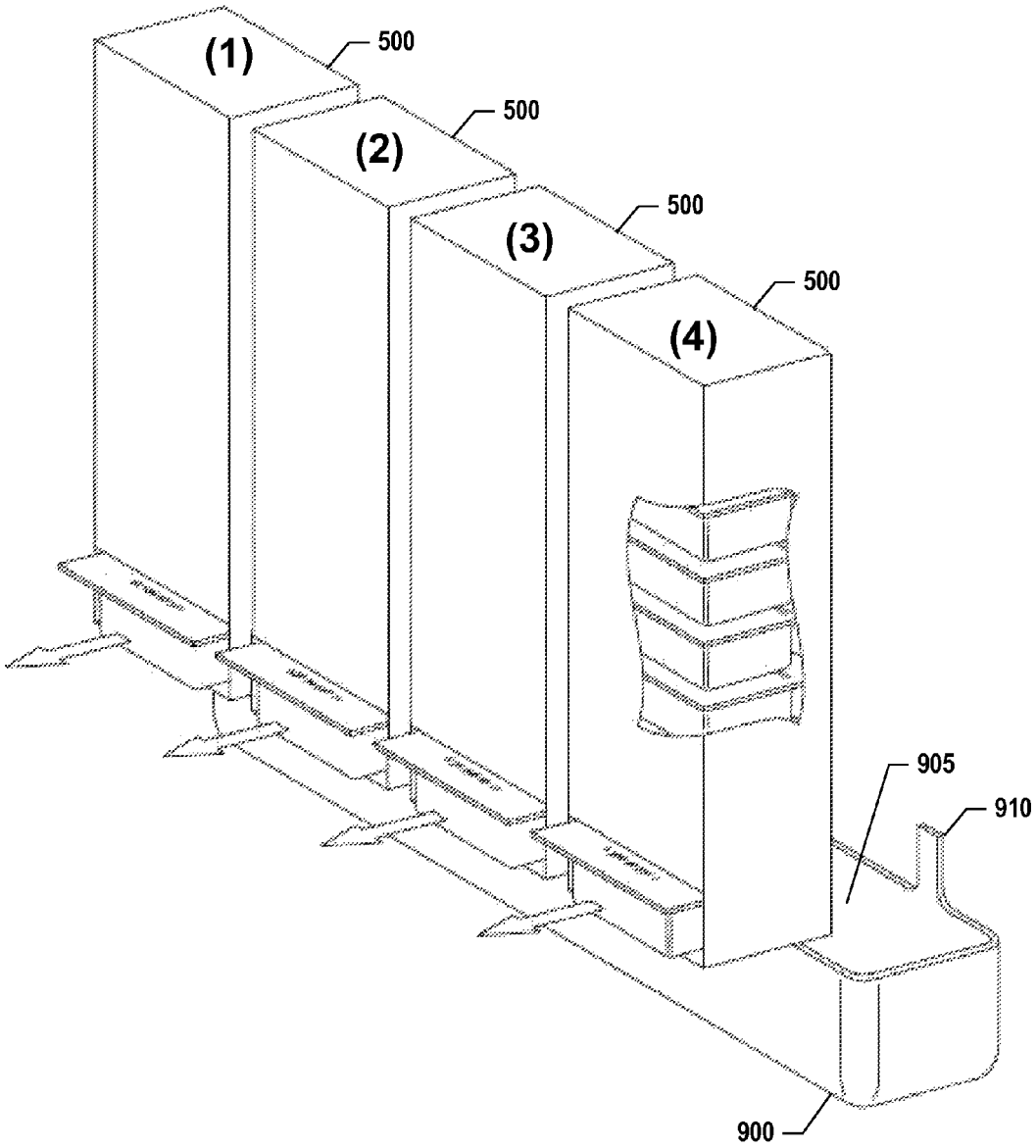
Figure 10:
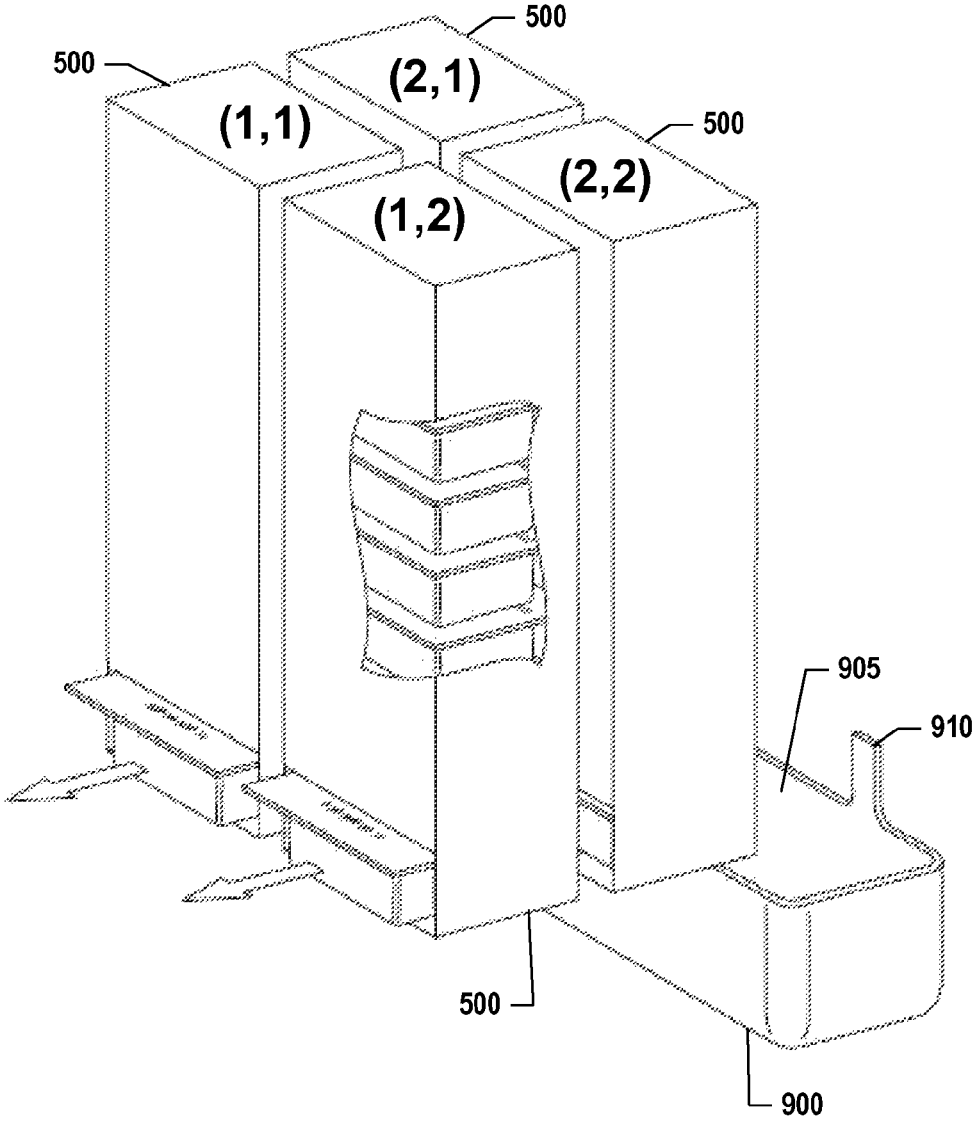

FIGS. 9 and 10 illustrate a plurality of magazines and receptacles according to one embodiment of the present invention.

Figure 11:
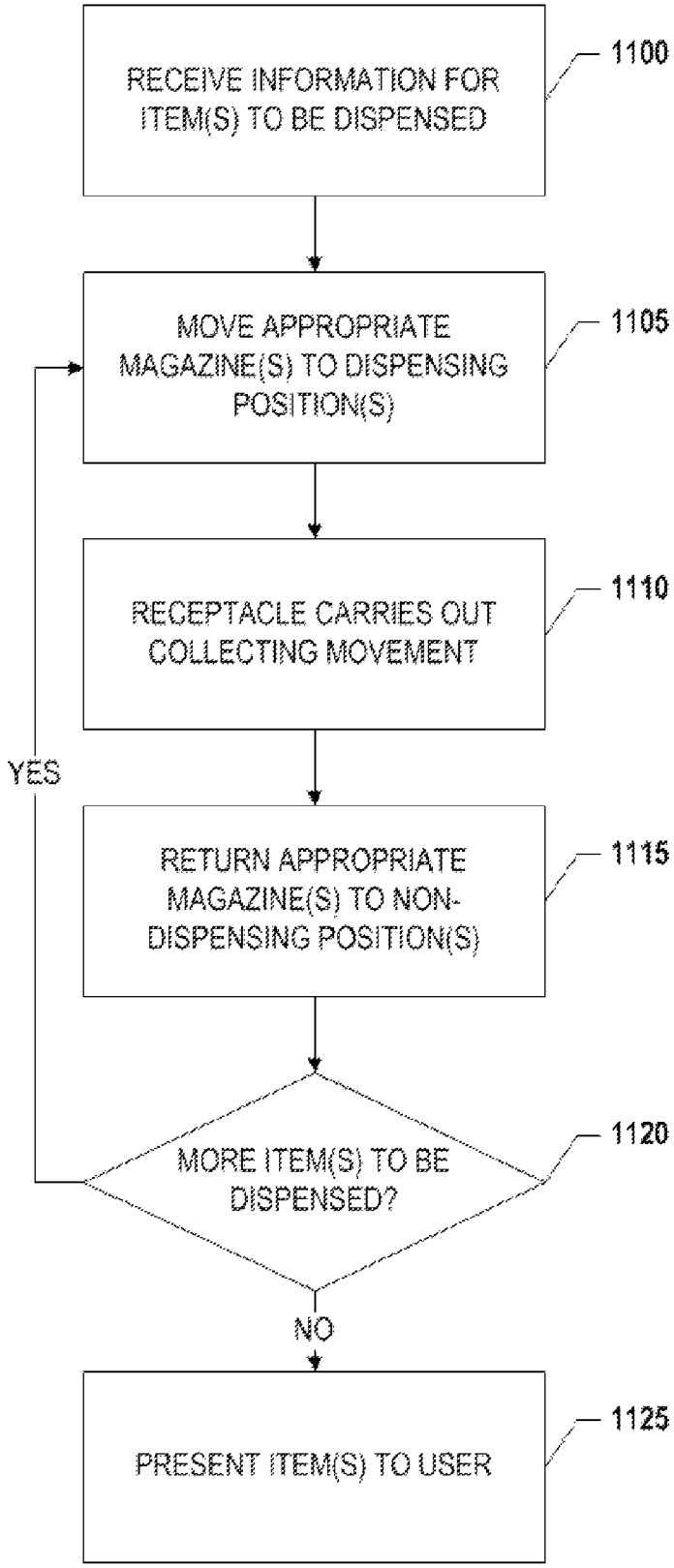

FIG. 11 is a flowchart illustrating operations and processes that can be used in accordance with various embodiments of the present invention.

DETAILED DESCRIPTION

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

I. Computer Program Products, Methods, and Computing Entities

Embodiments of the present invention may be implemented in various ways, including as computer program products. A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, program code, and/or similar terms). Such non-transitory computer-readable storage media include all computer-readable media (including volatile and non-volatile media), with the sole exception being a transitory, propagating signal.

In one embodiment, a non-volatile computer-readable storage medium may include a floppy disk, flexible disk, hard disk, magnetic tape, or any other non-transitory magnetic medium, and/or the like. A non-volatile computer-readable storage medium may also include a punch card, paper tape, optical mark sheet (or any other physical medium with patterns of holes or other optically recognizable indicia), compact disc read only memory (CD-ROM), compact disc compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory, multimedia memory cards (MMC), secure digital (SD) memory cards, Memory Sticks, and/or the like. Further, a non-volatile computer-readable storage medium may also include conductive-bridging random access memory (CBRAM), phase-change random access memory (PRAM), ferroelectric random-access memory (FeRAM), resistive random-access memory (RRAM), Silicon-Oxide-Nitride-Oxide-Silicon memory (SONOS), racetrack memory, and/or the like.

In one embodiment, a non-volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Rambus in-line memory module (RIMM), dual in-line memory module (DIMM), single in-line memory module (SIMM), video random access memory VRAM, cache memory, register memory, and/or the like. It will be appreciated that where embodiments are described to use a computer-readable storage medium, other types of computer-readable storage media may be substituted for or used in addition to the computer-readable storage media described above.

As should be appreciated, various embodiments of the present invention may also be implemented as methods, apparatus, systems, computing devices, computing entities, and/or the like. As such, embodiments of the present invention may take the form of an apparatus, system, computing device, computing entity, and/or the like executing instructions stored on a computer-readable storage medium to perform certain steps or operations. However, embodiments of the present invention may also take the form of an entirely hardware embodiment performing certain steps or operations.

Embodiments of the present invention are described below with reference to block diagrams and flowchart illustrations. Thus, it should be understood that each block of the block diagrams and flowchart illustrations, respectively, may be implemented in the form of a computer-readable storage medium, an entirely hardware embodiment, a combination of hardware and computer program products, and/or apparatus, systems, computing devices, computing entities, and/or the like carrying out instructions on a computer-readable storage medium for execution. Such embodiments can produce specifically-configured machines performing the steps or operations specified in the block diagrams and flowchart illustrations. Accordingly, the block diagrams and flowchart illustrations support various combinations of embodiments for performing the specified steps or operations.

II. Exemplary Dispensing Unit

Figure 1:
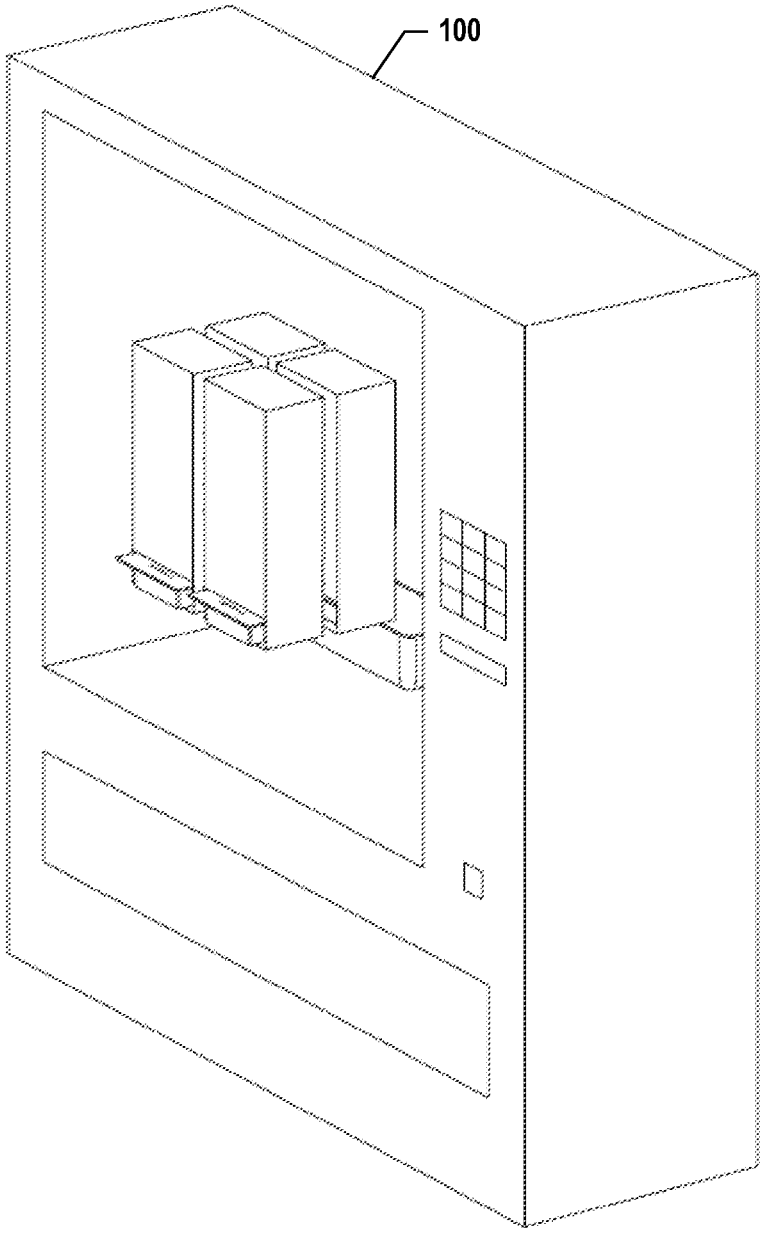
FIG. 1 is an overview of a dispensing unit according to one embodiment of the present invention.

FIG. 1 provides an illustration of an exemplary dispensing unit 100 according to one embodiment of the present invention. A dispensing unit 100 can be used to hold, store, or house (and similar terms used herein interchangeably) various items for dispensing and presentation of the same. Such items may include unit dose packages that are described in greater detail below. However, it should be noted that although embodiments of the present invention are described below with regard to dispensing unit dose packages, embodiments of the present invention may be applied to most any environment for dispensing items that are capable of being stacked, stored, or otherwise housed in a substantially uniform manner. As will be described, the dispensing unit 100 may include a variety of components and features for performing or enabling the performance of the functions described herein.

1. Exemplary Dispensing Unit Computing Entity

Figure 2:
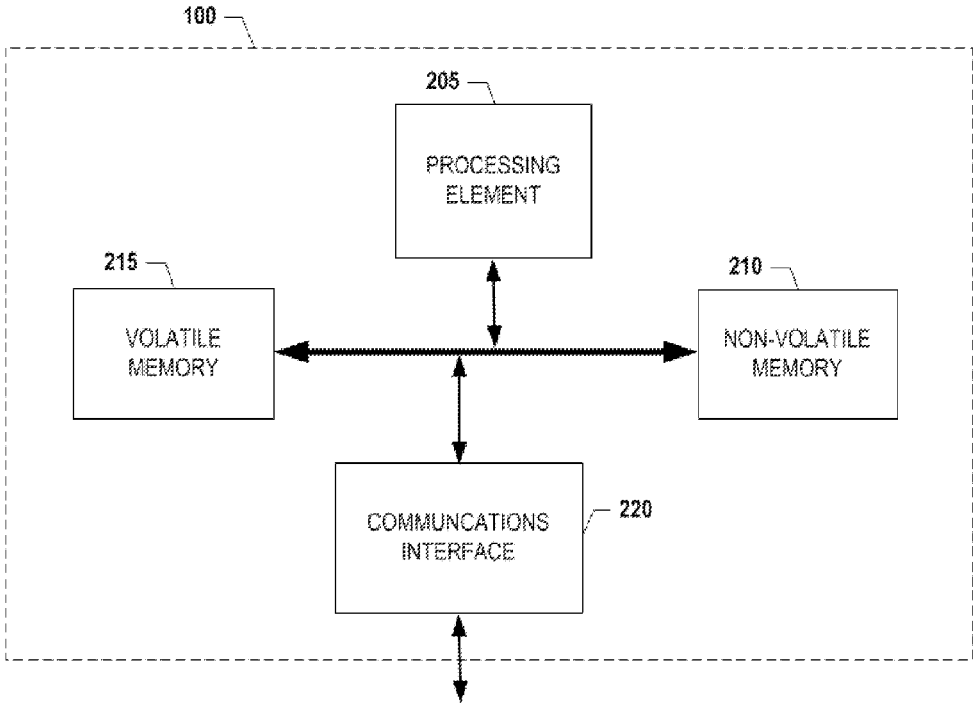
FIG. 2 is an exemplary schematic diagram of a dispensing unit computing entity according to one embodiment of the present invention.
Figure 3A:
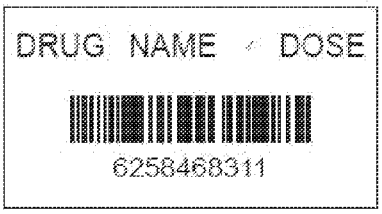
Figure 3B:
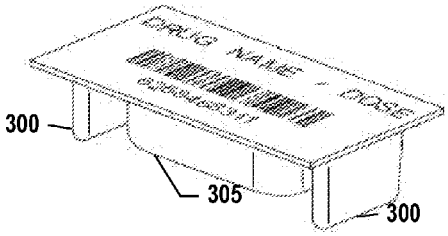
Figure 3C:
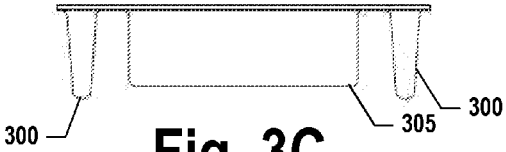
Figure 3D:
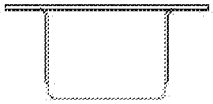
Figure 3E:
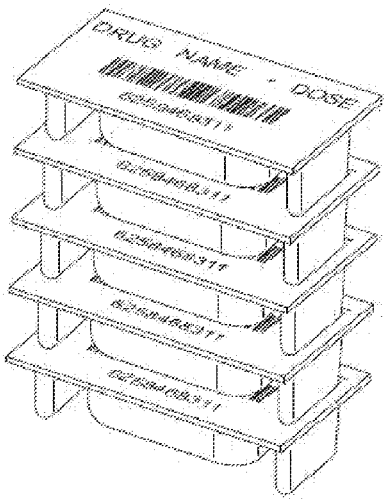
Figure 3F:
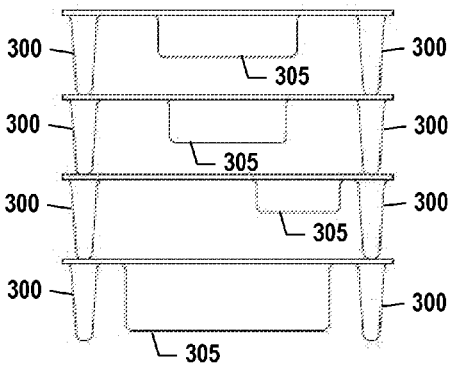
Figure 4A:
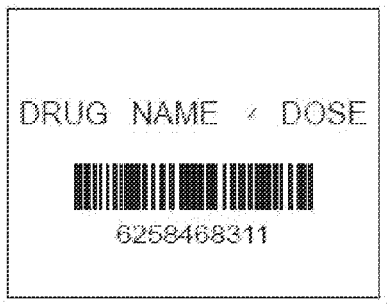
Figure 4B:
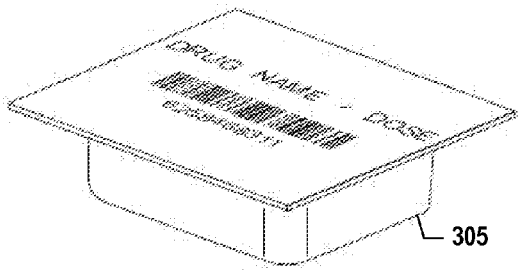
Figure 4C:
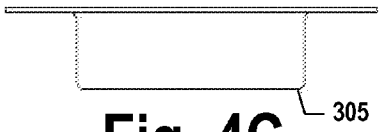
Figure 4D:
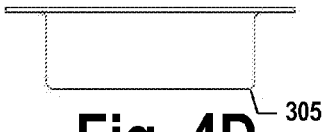
Figure 4E:
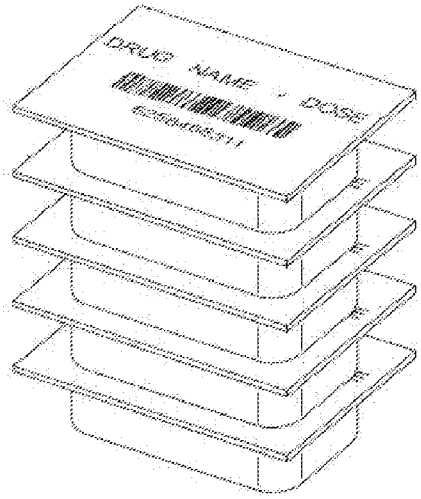
Figure 4F:
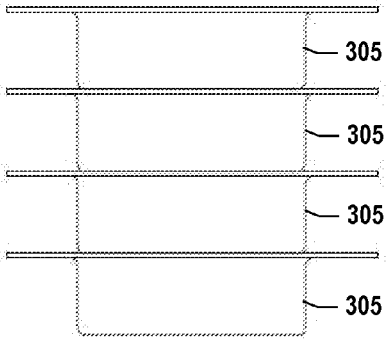
Figure 5:
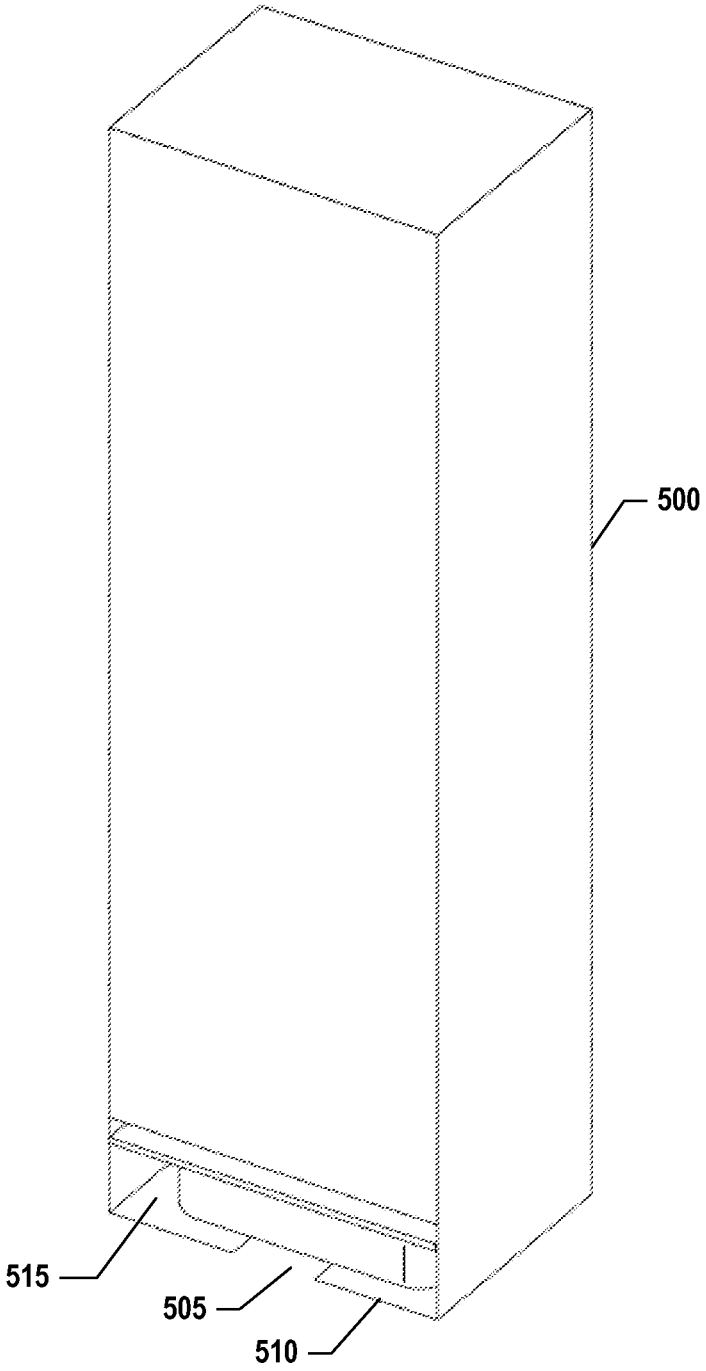

In one embodiment, the dispensing unit 100 comprises a dispensing unit computing entity. FIG. 2 provides a schematic of a dispensing unit computing entity according to one embodiment of the present invention. In one embodiment, the dispensing unit computing entity can be used to control various aspects of the dispensing unit 100. For example, the dispensing unity computing entity can control movement of the magazines 500 and the receptacles 900, monitoring and communicating inventory levels, and control presentation of items being dispensed. As will be recognized, the term computing entity may refer to, for example, one or more computers, computing devices, computing entities, mobile phones, desktops, tablets, notebooks, laptops, distributed systems, servers, proxies, blades, gateways, switches, processing devices, processing entities, relays, routers, network access points, base stations, the like, and/or any combination of devices or entities adapted to perform the functions described herein. As shown in FIG. 2, in one embodiment, the dispensing unit computing entity may include or be in communication with one or more processing elements 205 (also referred to as processors, processing circuitry, and/or similar terms used herein interchangeably) that communicate with other elements within the dispensing unit computing entity via a bus, for example. As will be understood, the processing element 205 may be embodied in a number of different ways. For example, the processing element 205 may be embodied as one or more complex programmable logic devices (CPLDs), microprocessors, multi-core processors, coprocessing entities, application-specific instruction-set processors (ASIPs), and/or controllers. Further, the processing element 205 may be embodied as one or more other processing devices or circuitry. The term circuitry may refer to an entirely hardware embodiment or a combination of hardware and computer program products. Thus, the processing element 205 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 205 may be configured for a particular use or configured to execute instructions stored in volatile or non-volatile media or otherwise accessible to the processing element 205. As such, whether configured by hardware or computer program products, or by a combination thereof, the processing element 205 may be capable of performing steps or operations according to embodiments of the present invention when configured accordingly.

In one embodiment, the dispensing unit computing entity may further include or be in communication with non-volatile media (also referred to as non-volatile storage, memory, memory storage, memory circuitry and/or similar terms used herein interchangeably). In one embodiment, the non-volatile storage or memory may include one or more non-volatile storage or memory media 210 as described above, such as hard disks, ROM, PROM, EPROM, EEPROM, flash memory, MMCs, SD memory cards, Memory Sticks, CBRAM, PRAM, FeRAM, RRAM, SONOS, racetrack memory, and/or the like. As will be recognized, the non-volatile storage or memory media may store databases, data, applications, programs, program modules, scripts, source code, object code, byte code, compiled code, interpreted code, machine code, executable instructions, and/or the like.

In one embodiment, the dispensing unit computing entity may further include or be in communication with volatile media (also referred to as volatile storage, memory, memory storage, memory circuitry and/or similar terms used herein interchangeably). In one embodiment, the volatile storage or memory may also include one or more volatile storage or memory media 215 as described above, such as RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. As will be recognized, the volatile storage or memory media may be used to store at least portions of the databases, data, applications, programs, program modules, scripts, source code, object code, byte code, compiled code, interpreted code, machine code, executable instructions, and/or the like being executed by, for example, the processing element 205. Thus, the databases, data, applications, programs, program modules, scripts, source code, object code, byte code, compiled code, interpreted code, machine code, executable instructions, and/or the like may be used to control certain aspects of the operation of the dispensing unit computing entity with the assistance of the processing element 205 and operating system. For example, as described above, the dispensing unit computing entity can be used to control certain aspects of the dispensing unit 100, such as controlling movement of the magazines 500 and the receptacles 900, monitoring and communicating inventory levels, and controlling presentation of items being dispensed.

As indicated, in one embodiment, the dispensing unit computing entity may also include one or more communications interfaces 220 for communicating with various computing entities, such as by communicating data, content, information, and/or similar terms used herein interchangeably that can be transmitted, received, operated on, processed, displayed, stored, and/or the like. Such direct or indirect communication may be via the same or different wired or wireless networks (or a combination of wired and wireless networks). For instance, the communication may be executed using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, the dispensing unit computing entity may be configured to communicate via wireless external communication networks using any of a variety of protocols, such as general packet radio service (GPRS), Universal Mobile Telecommunications System (UMTS), Code Division Multiple Access 2000 (CDMA2000), CDMA2000 1X (1xRTT), Wideband Code Division Multiple Access (WCDMA), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), 802.16 (WiMAX), ultra wideband (UWB), infrared (IR) protocols, Bluetooth™ protocols, wireless universal serial bus (USB) protocols, and/or any other wireless protocol.

Although not shown, the dispensing unit computing entity may include or be in communication with one or more input elements, such as a keyboard input, a mouse input, a touch screen/display input, audio input, pointing device input, joystick input, keypad input, and/or the like. The dispensing unit computing entity may also include or be in communication with one or more output elements (not shown), such as audio output, video output, screen/display output, motion output, movement output, and/or the like.

As will be appreciated, one or more of the dispensing unit computing entity's components may be located remotely from other dispensing unit computing entity components. Furthermore, one or more of the components may be combined and additional components performing functions described herein may be included in the dispensing unit computing entity. Thus, the dispensing unit computing entity can be adapted to accommodate a variety of needs and circumstances for dispensing and presenting items, such as unit dose packages.

2. Exemplary Unit Dose Package

In one embodiment, a unit dose package may refer to a unit dose medication that has been sealed in a package. In one embodiment, unit dose packages may provide a substantially flat upper surface with information printed or disposed thereon. Such information printed or disposed thereon may include an identification code (e.g., barcode, radio frequency identification (RFID) tag, or simple text including any number and combination of alphanumeric characters) that identifies the medication and dosage in the unit dose package.

In one embodiment, unit dose packages may conform to one of many standard dimensions. For example, as shown in FIGS. 3A, 3B, 3C, 3D, 3E, and 3F, unit dose packages may be of a substantially uniform length, uniform width, and uniform height for each standard. The unit dose packages may also include substantially uniform legs 300 having a uniform height. This uniformity can allow for unit dose packages to define cavities 305 that can be of a variety of sizes and shapes to accommodate various types, sizes, quantities, and strengths of medications (see FIG. 3F). That is, the cavity 305 can be individually sized to accept a specific type, size, quantity, and/or strength of medication while the unit dose package itself is of substantially standard dimensions. As shown in FIGS. 3A, 3B, 3C, 3D, 3E, and 3F, the substantially flat upper surfaces and substantially uniform legs 300 allow the unit dose packages (with potentially varying cavity 305 sizes and shapes) to be stacked on one another (or be held in a similar configuration). Further, such a configuration allows for a stack of unit dose packages to be maintained at a consistent height and contained in a repeatable or uniform manner. Thus, as previously noted and shown in FIG. 3F, even though the size and shape of the cavities 305 may vary, the overall stack height and form of the unit dose packages remains the same.

In another embodiment, unit dose packages may have a cavity 305 that conforms to one of many standard dimensions. In one embodiment, such a cavity 305 may be adapted to accommodate various types, sizes, quantities, and strengths of medications. For example, as shown in FIGS. 4A, 4B, 4C, 4D, 4E, and 4F, the cavity 305 may be sufficiently sized and shaped to store various types of medications—regardless of the sizes and shapes of the medications. Thus, because the cavity 305 is of a standard size and shape and the unit dose packages have substantially flat upper surfaces, the unit dose packages may be stacked on one another (or be held in a similar configuration). Further, a stack of such unit dose packages can be maintained at a consistent height and contained in a repeatable or uniform manner.

In one embodiment, standardized unit dose packages (or other items or packaging) can facilitate storing, retrieving, and dispensing unit dose packages (or other items or packaging) via the dispensing unit 100. As will be recognized, the unit dose packages illustrated and described herein are only examples of unit dose packages that may be handled in accordance with exemplary embodiments of the present invention.

3. Exemplary Magazines

In one embodiment, the dispensing unit may comprise one or more magazines 500 that conform to one of many standard dimensions based on, for example, the unit dose packages they are designed to store. For example, as shown in FIGS. 5-8, a magazine 500 may comprise a front, a back, sides, a top, and a bottom. In one embodiment, the interior of the front, back, and sides of the magazine 500 may define a channel that is sized to accept one or more unit dose packages, such as those described above. As shown in FIGS. 5-8, this configuration allows any number of unit dose packages to be accepted and stored in a stacked arrangement. For example, in one embodiment, a magazine 500 may be sized to accept and store unit dose packages that are one inch in height, two inches in width, and four inches in length. In another embodiment, a magazine 500 may be sized to accept and store unit dose packages that are two inches in height, four inches in width, and six inches in length. Magazines 500 of different dimensions can be used with a single dispensing unit 100 to dispense different sizes of unit dose packages (or other items or packaging).

Additionally, in one embodiment, the front of the magazine 500 may define a dispensing opening 510 proximate the bottom and sliding surface 515 of the magazine 500. As shown in FIGS. 9 and 10, the dispensing opening 510 allows for unit dose packages to be urged on the sliding surface 515 toward the front of the magazine 500 and out of the dispensing opening 510. As will be recognized, the dispensing opening 510 can be sized to allow one unit dose package to be urged from the dispensing opening 510 at a time. Accordingly, the remaining unit dose packages remain in the channel of the magazine 500 when the unit dose package in contact with the sliding surface 515 of the bottom is urged out of the dispensing opening 510.

Figure 6:
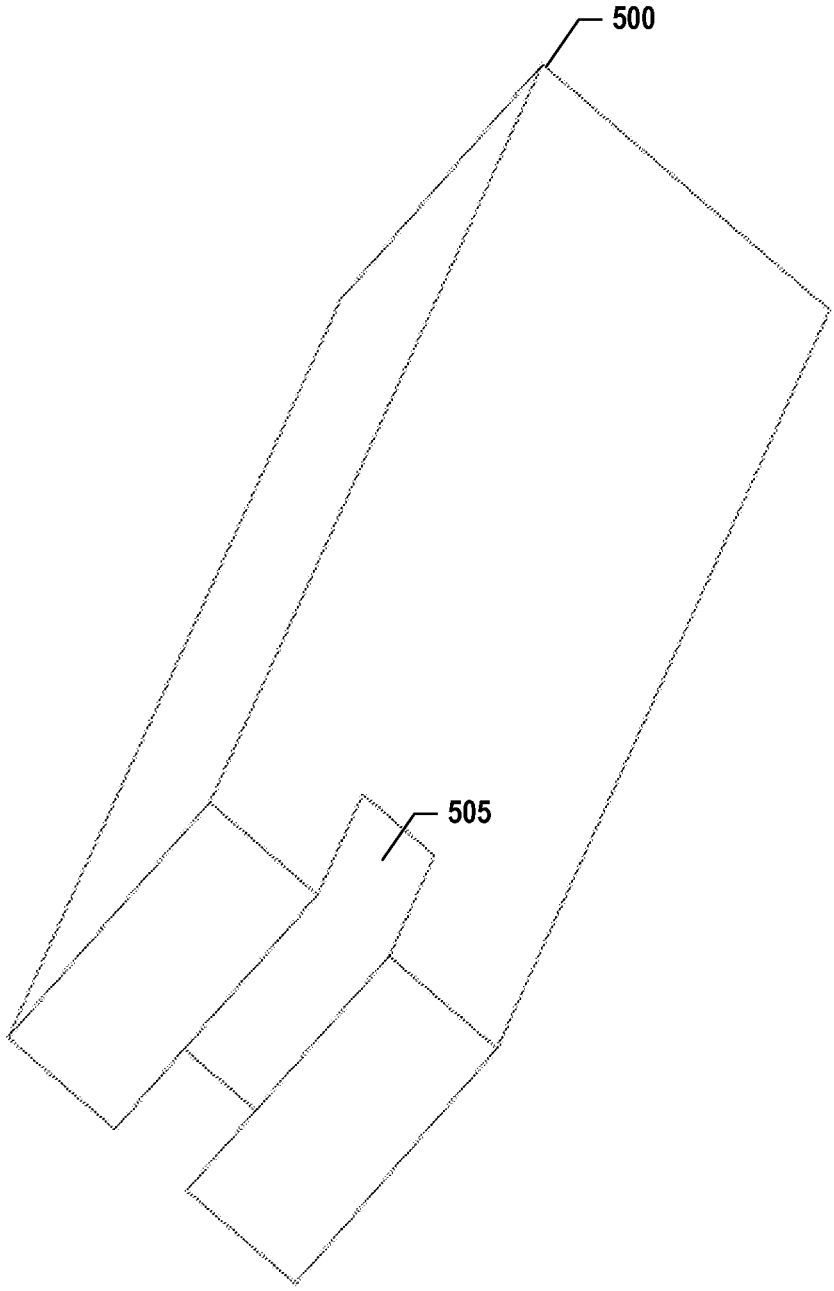
Figure 7:
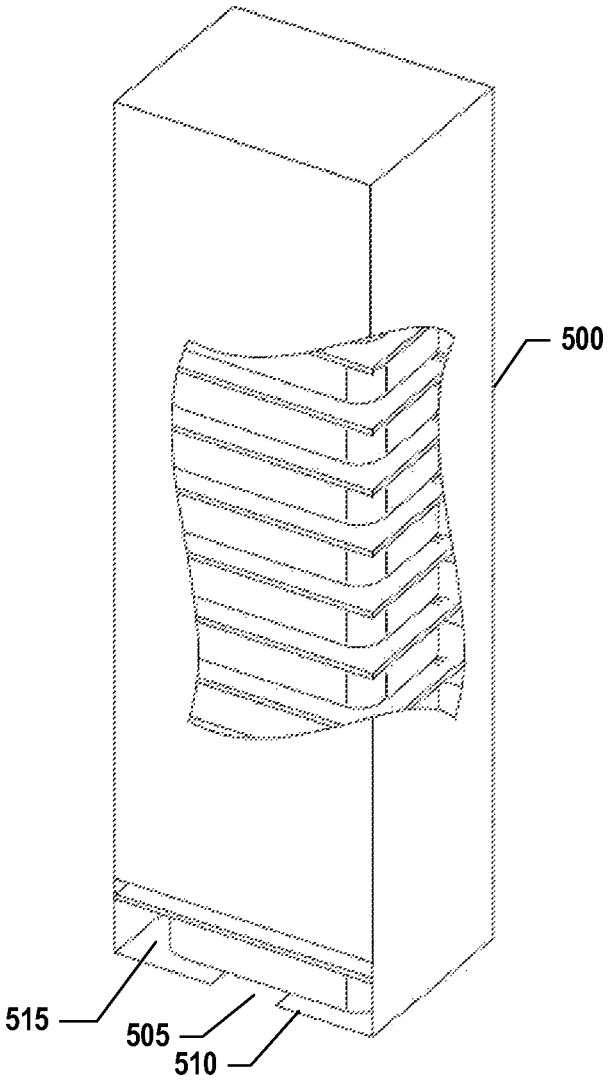

In addition to the dispensing opening 510, in one embodiment, the magazine 500 can define a rake element path 505. As shown in FIG. 6, the rake element path 505 can be defined from the bottom of the back of the magazine 500 through the front of the dispensing opening 510. The rake element path 505 can be sized and shaped to allow for a rake element 910 to pass through the rake element path 505 to engage a unit dose package in contact with the sliding surface 515 of the bottom to urge the unit dose package out of the dispensing opening 510.

In one embodiment, the magazine 500 may be secured, attached, mounted, and similar terms used herein interchangeably to a frame within the dispensing unit 100 (not shown) for selective movement of the magazine 500. The selective movement may allow the magazine 500 to be selectively moved from a non-dispensing position to a dispensing position and back (e.g., via the dispensing unit computing entity). In a particular embodiment, the magazine 500 can be secured or attached to a frame in a vertical position with respect to the top and bottom of the magazine 500. This may allow the magazine 500 to be selectively lowered from its non-dispensing position within the dispensing unit 100 to a dispensing position. Further, because the magazines 500 may be of different dimensions, each magazine 500 may need to be lowered a unique distance to its dispensing position. For example, a magazine 500 storing unit dose packages that are one inch in height, two inches in width, and four inches in length may need to be lowered four inches to be in dispensing position. Similarly, a magazine 500 storing unit dose packages that are two inches in height, four inches in width, and six inches in length may need to be lowered three inches to be in dispensing position. Once in dispensing position, a unit dose package in contact with the sliding surface 515 of the bottom can be urged out of the dispensing opening 510 and gravity can urge the remaining unit dose packages toward the bottom of the magazine 500. After dispensing a unit dose package, the magazine can be raised to its non-dispensing position within the dispensing unit 100 (e.g., via the dispensing unit computing entity).

Figure 8:
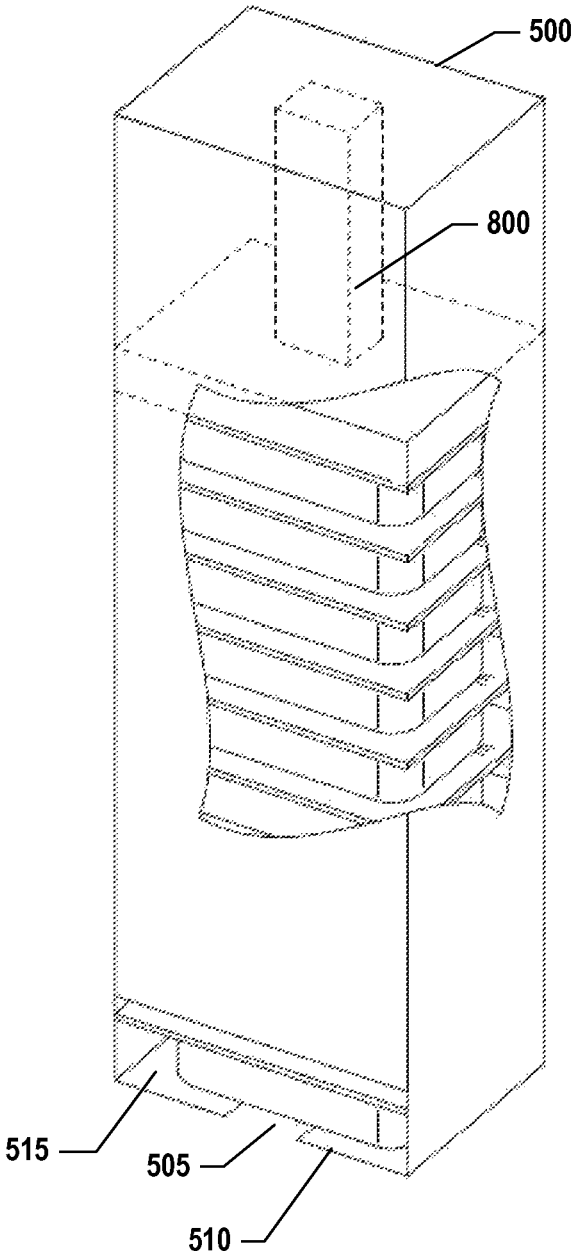

As will be recognized, the magazine 500 may be secured or attached to a frame within the dispensing unit 100 in a variety of other manners with different orientations (not shown). For example, in one embodiment, the magazine 500 can be secured or attached to a frame in a horizontal position with respect to the top and bottom of the magazine 500. In such an embodiment, as shown in FIG. 8, the top of the magazine 500 may include a spring mechanism 800 (or other biasing mechanism) to constantly urge the unit dose packages toward the bottom of the magazine 500. Further, in such an embodiment, the magazine 500 can be selectively moved to the left or right (or right to left) from a non-dispensing position within the dispensing unit 100 to a dispensing position (e.g., via the dispensing unit computing entity). As a unit dose package in contact with the sliding surface 515 of the bottom is urged out of the dispensing opening 510, the spring mechanism 800 (or other biasing mechanism) can urge the remaining unit dose packages toward the bottom of the magazine 500 (e.g., from left to right or right to left). After dispensing a unit dose package, the magazine 500 can be returned to its non-dispensing position within the dispensing unit 100.

Although not shown, in one embodiment, the magazine 500 may define a feeding opening through which unit dose packages can be fed into the magazine 500. The feeding opening can be sized to allow one unit dose package to be fed at a time into the magazine 500. In another embodiment, the top of the magazine 500 can be selectively removable to feed unit dose packages into the magazine 500. In yet another embodiment, the magazines 500 may be replaceable within the dispensing unit 100. Regardless, each magazine may comprise an identification code (e.g., barcode, RFID tag, or simple text including any number and combination of alphanumeric characters) that identifies the medication and dosage in the unit dose packages stored within the magazine 500. Thus, each time a magazine 500 is replaced or refilled, an integrated scan of the same can record the position of the magazine 500 to ensure that the correct unit dose packages are being dispensed. As will be recognized, a variety of other approaches and techniques can be used to adapt to various needs and circumstances.

In one embodiment, in addition to orientation, the one or more magazines 500 can be mounted to a frame in the dispensing unit 100 in a variety of configurations. For example, as shown in FIG. 9, the magazines 500 can be secured to a frame in a single row configuration for selective (e.g., individual) movement. FIG. 9 shows a row of magazines 500 with positions for each magazine: positions (1), (2), (3), and (4). In one embodiment, the dispensing unit computing entity can store the location of each magazine 500 and the corresponding contents—both inventory levels and types, sizes, quantities, and strengths of medications in the unit dose packages. For example, the magazine 500 in position (1) may store unit dose packages with 400 mg of Acetaminophen. The magazine 500 in position (2) may store unit dose packages with 60 mg of Oxycodone. The magazine 500 in position (3) may store unit dose packages with 875 mg of Amoxicillin. And the magazine 500 in position (4) may store unit dose packages with 80 mg Lipitor. The dispensing unit computing entity can cause selective movement of the appropriate magazines 500 from non-dispensing positions to dispensing positions so requested unit does packages can be dispensed.

In the embodiment shown in FIG. 10, the magazines 500 can be secured to a frame in a grid configuration for selective (e.g., individual) movement. FIG. 10 shows a 4×4 grid configuration of magazines 500. In this example, each of positions (1,1), (1,2), (2,1), and (2,2) correspond to a distinct magazine 500. In one embodiment, the dispensing unit computing entity can store the location of each magazine 500 and the corresponding contents—both inventory levels and types, sizes, quantities, and strengths of medications in the unit dose packages. For example, the magazine 500 in position (1,1) may store unit dose packages with 400 mg of Acetaminophen. The magazine 500 in position (1,2) may store unit dose packages with 60 mg of Oxycodone. The magazine 500 in position (2,1) may store unit dose packages with 875 mg of Amoxicillin. And the magazine 500 in position (2,2) may store unit dose packages with 80 mg of Lipitor. In an embodiment with a grid format, the magazines 500 may be lowered in alternating rows.

4. Exemplary Receptacles

In one embodiment, the dispensing unit 100 may comprise one or more receptacles 900. A receptacle 900 may be a drawer, bin, bag, pouch, compartment, and/or the like. In a particular embodiment shown in FIGS. 9 and 10, a receptacle 900 may comprise a front, a back, sides, and a bottom. The interior of the front, back, sides, and bottom may define a storage cavity 905 that is sized to accept a plurality of unit dose packages as they are urged from magazines 500. To urge unit dose packages from magazines 500, the receptacle 900 may comprise one or more rake elements extending from the back rim of the receptacle 900. In one embodiment, there may be a rake element 910 for each row or column of magazines. For example, in the embodiment, of FIG. 9, the receptacle 900 may include four rake elements 910, one for each aligned magazine 500. In the embodiment of FIG. 10, the receptacle 900 may include two rake elements 910, one for each row or column of magazines 500. In another embodiment (not shown), the receptacle 900 may include multiple rows of rake elements 910.

As shown in FIGS. 9 and 10, the rake elements 910 can be sized and shaped to pass through at least a portion of a rake element path 505 of at least one magazine 500. While passing through the back of a rake element path 505 toward the front of a magazine 500, the rake element 910 can engage a unit dose package that is in contact 500 with the sliding surface 515 of the bottom of the magazine 500 and urge it out of the dispensing opening 510 and into the receptacle's storage cavity 905.

In one embodiment, such a receptacle 900 may be secured, attached, mounted, and similar terms used herein interchangeably to a frame within the dispensing unit 100 (not shown) for selective movement of the receptacle 900 (e.g., via the dispensing unit computing entity). This may allow the receptacle 900 to be selectively moved from a non-collecting position to carry out a collection movement. In one embodiment, the collection movement may comprise moving the receptacle 900 from the non-collecting position (e.g., in the back of one or more magazines 500) toward the front of the magazines 500 and back to the non-collecting position.

After dispensing the unit dose packages, the unit dose packages can be presented to a user. For instance, the receptacle 900 may move (e.g., via the dispensing unit computing entity) to a presenting position from which a user could access the unit dose packages. In another embodiment, the receptacle 900 may dump the unit dose packages into a drawer or other compartment (e.g., via the dispensing unit computing entity) from which a user could access the unit dose packages. In still another embodiment, the receptacle 900 may dump the unit dose packages onto a conveyor (e.g., via the dispensing unit computing entity) for presentation to a user. As will be recognized, certain embodiments may be more manual in nature. For example, in one embodiment, the receptacle 900 may be a drawer that can be pulled forward by a user to dispense unit does packages and present the same to the user. As will be recognized, a variety of other approaches and techniques can be used to adapt to various needs and circumstances.

III. Exemplary Operation of Dispensing Unit

FIG. 11 provides steps for dispensing items (e.g., unit dose packages) from dispensing units 100 according to one embodiment of the present invention. The process may begin at Block 1100 with the dispensing unit computing entity receiving information for items that are to be dispensed. Such information can be received in a variety of ways including via input from a user, a communication from another computing entity, and/or the like.

After receiving such information, the dispensing unit (e.g., via the dispensing unit computing entity) can move the appropriate magazines to their respective dispensing positions (Block 1105). In one embodiment, this may involve lowering the appropriate magazines 500 a configurable distance (such as three inches) to a common dispensing position. In another embodiment, this may involve lowering each magazine 500 a configurable distance that corresponds to the magazine 500. For example, a magazine 500 storing unit dose packages that are one inch in height, two inches in width, and four inches in length may need to be lowered four inches to be in dispensing position. Similarly, a magazine 500 storing unit dose packages that are that are two inches in height, four inches in width, and six inches in length may need to be lowered three inches to be in dispensing position. As will be recognized, this configurable distance (and orientation of the movement) may vary to adapt to different needs and circumstances.

In one embodiment, the dispensing unit (e.g., via the dispensing unit computing entity) can then move the receptacle 900 through its collection movement (Block 1110). The collection movement may be selectively moving the receptacle 900 from a non-collecting position in the back of one or more magazines 500 toward the front of the magazines 500. Through the collection movement, the respective rake elements 910 can pass through the rake element paths 505 of lowered magazines 500. By passing through a given rake element path 505, the rake elements 910 can engage individual unit dose packages in contact with sliding surfaces 515 to urge them out of the respective dispensing openings 510. In the embodiment of FIG. 9, for instance, the receptacle 900 would have four rake elements 910, with each rake elements 910 passing through a different rake element path 505. In the embodiment of FIG. 11, the receptacle 900 would have two rake elements 910 passing through two different rake element paths 505 each (provided the magazines 500 are sufficiently spaced apart), with the rake element paths 505 of the magazines 500 in positions (1,1) and (2,1) being substantially aligned and the rake element paths 505 of the magazines 500 in positions (1,2) and (2,2) being substantially aligned.

As shown in Block 1115, any lowered magazines can then be returned to their non-dispensing positions. For embodiments in which the magazines 500 in the grid configuration are not sufficiently spaced apart to allow two adjacent magazines to be lowered at the same time (e.g., magazines 500 in positions (1,1) and (2,1) or the magazines 500 in positions (1,2) and (2,2)), this can complete the first pass of dispensing unit does packages. This is because in a grid format, for magazines 500 that are stored in the dispensing unit 100 close together, the magazines 500 may be required to be moved to their dispensing positions in alternating rows. In such an embodiment, no two magazines 500 are moved to their dispensing positions at the same time if they are in adjacent positions with regard to the alignment of the rake element paths 505 as described above. For instance, in FIG. 10, the magazines 500 in positions (1,1) and (2,1) would not be moved to their dispensing positions at the same time since the unit dose package being ejected from the magazine 500 in position (2,1) would be urged into the back of the magazine 500 in position (1,1). Similarly, the magazines 500 in positions (1,2) and (2,2) would not be moved to their dispensing positions at the same time since the unit dose package being ejected from the magazine 500 in position (2,2) would be urged into the back of the magazine in position (1,2). However, regardless of the number of magazines 500 in the grid configuration, the magazines 500 can be arranged such that no more than two collection movements are required by the receptacle 900 to dispense the unit does packages requested—provided no more than one unit dose package is required from a particular magazine 500. If more than one unit dose package is required from a particular magazine 500, the receptacle 900 would make the same number of collection movements to dispense the unit does packages.

Continuing with the above grid configuration, after completing the first collection movement and returning the magazines 500 to their non-dispensing positions, the dispensing unit (e.g., via the dispensing unit computing entity) can determine if any other unit does packages need to be dispensed (Block 1120). If so, the dispensing unit (e.g., via the dispensing unit computing entity) can move any other appropriate magazines 500 to their respective dispensing positions (Block 1105), move the receptacle 900 through its collection movement (Block 1110), and return the magazines 500 to their non-dispensing positions.

In an alternative embodiment, the receptacle 900 may have multiple rows of rake elements 910 (not shown). Thus, in a grid configuration, a single collection movement can be used by appropriately raising and lowering the magazines 500, for example, with specified timing and coordination with regard to the receptacle 900 collection movement. For instance, certain magazines 500 can be lowered to their dispensing positions and the receptacle 900 can complete part of its collection movement and stop (e.g., move forward a predetermined distance and stop). Then, the lowered magazines 500 can be returned to their non-dispensing positions and appropriate magazines 500 in alternating rows can be lowered to their dispensing positions for the receptacle 900 to complete its collection movement (e.g., complete its forward movement and return to the non-collecting position). As will be recognized, though, a variety of other approaches and techniques can also be used to adapt to various needs and circumstances.

As indicated in Block 1125, the unit dose packages can then be presented to a user. As described above, this may include moving the receptacle 900 (e.g., via the dispensing unit computing entity) to a presenting position from which a user could access the dispensed unit dose packages. It may also include the receptacle 900 dumping the unit dose packages into a drawer or onto a conveyor for presentation to the user. Further, the dispensing unit 100 (e.g., via the dispensing unit computing entity) can also track the inventory of unit dose packages that are refilled, replaced, and/or dispensed from the dispensing unit 100.

III. Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for dispensing items, the apparatus comprising:

a magazine comprising a front, a back, a first side, a second side, and a bottom, wherein (a) the front, the back, the first side, and the second side define a channel adapted to store a plurality of items of substantially similar size in a uniform manner, (b) the bottom defines a rake element path adapted to allow an item of the plurality of items in contact with the bottom to be engaged, and (c) the front defines a dispensing opening adapted to allow the engaged item to be urged out of the dispensing opening; and a receptacle comprising a storage cavity and a rake element, wherein the rake element is adapted to (a) pass through the rake element path of the magazine to engage a first item of the plurality of items and (b) urge the first item out of the dispensing opening of the magazine into the storage cavity of the receptacle.

2. The apparatus of claim 1, wherein the magazine is mounted to a frame adapted to selectively move the magazine from a non-dispensing position to a dispensing position.

3. The apparatus of claim 2, wherein the receptacle is mounted to a frame adapted to selectively move the receptacle from a non-collecting position through a collection movement in which the rake element (a) passes through the rake element path of the magazine to engage the first item of the plurality of items and (b) urges the first item out of the dispensing opening of the magazine into the storage cavity of the receptacle.

4. The apparatus of claim 3, wherein the plurality of items comprise unit dose packages.

5. An apparatus for dispensing items, the apparatus comprising:

a plurality of magazines, wherein (a) each magazine comprises a front, a back, a first side, a second side, and a bottom, (b) the front, the back, the first side, and the second side of each magazine define a channel adapted to store a plurality of items of substantially similar size in a uniform manner, (b) the bottom of each magazine defines a rake element path adapted to allow an item of the plurality of items stored therein and in contact with the bottom to be engaged, and (c) the front of each magazine defines a dispensing opening adapted to allow the engaged item of each magazine to be urged out of the dispensing opening; and a receptacle comprising a storage cavity and a rake element, wherein the rake element is adapted to (a) pass through the rake element path of a first magazine to engage a first item and (b) urge the first item out of the dispensing opening of the first magazine into the storage cavity of the receptacle.

6. The apparatus of claim 5, wherein the plurality of magazines is mounted to a frame adapted to selectively move each magazine independently from respective non-dispensing positions to respective dispensing positions.

7. The apparatus of claim 6, wherein the receptacle is mounted to a frame adapted to selectively move the receptacle from a non-collecting position through a collection movement in which the rake element (a) passes through the rake element path of the first magazine to engage the first item and (b) urge the first item out of the dispensing opening of the first magazine into the storage cavity of the receptacle.

8. The apparatus of claim 7, wherein the rake element through the collection movement (a) passes through the rake element path of a second magazine to engage a second item and (b) urge the second item out of the dispensing opening of the second magazine into the storage cavity of the receptacle.

9. The apparatus of claim 8, wherein the plurality of magazines are attached to the frame in a grid configuration.

10. The apparatus of claim 8, wherein the plurality of magazines in the grid configuration are adapted to be selectively moved from their respective non-dispensing positions to their respective dispensing positions in at least one of alternating rows or alternating columns.

11. The apparatus of claim 5, wherein the plurality of items comprise unit dose packages.

12. A method for dispensing items, the method comprising:

receiving, via one or more processors, information of an item to be dispensed, wherein (a) the item is stored in a magazine defining a channel adapted to store a plurality of items of substantially similar size in a uniform manner, (b) the magazine defines a rake element path adapted to allow the item to be engaged, and (c) the magazine defines a dispensing opening adapted to allow the item to be urged out of the dispensing opening;

identifying, via the one or more processors, the magazine storing the item;

causing, via the one or more processors, the magazine to be moved from a non-dispensing position to a dispensing position; and causing, via the one or more processors, a receptacle to be moved from a non-collecting position through a collection movement, wherein (a) the receptacle comprises a storage cavity and a rake element, (b) via the collection movement the rake element passes through the rake element path of the magazine to engage the first item and urge the first item out of the dispensing opening of the magazine into the storage cavity of the receptacle.

13. The method of claim 12, wherein the plurality of items comprise unit dose packages.

14. The method of claim 12 further comprising causing, via the one or more processors, the item to be presented to a user.

15. A computer program product for dispensing items, the computer program product comprising at least one non-transitory computer-readable storage medium having computer-readable program code portions stored therein, the computer-readable program code portions comprising:

an executable portion configured to receive information of an item to be dispensed, wherein (a) the item is stored in a magazine defining a channel adapted to store a plurality of items of substantially similar size in a uniform manner, (b) the magazine defines a rake element path adapted to allow the item to be engaged, and (c) the magazine defines a dispensing opening adapted to allow the item to be urged out of the dispensing opening;

an executable portion configured to identify the magazine storing the item;

an executable portion configured to cause the magazine to be moved from a non-dispensing position to a dispensing position; and an executable portion configured to cause a receptacle to be moved from a non-collecting position through a collection movement, wherein (a) the receptacle comprises a storage cavity and a rake element, (b) via the collection movement the rake element passes through the rake element path of the magazine to engage the first item and urge the first item out of the dispensing opening of the magazine into the storage cavity of the receptacle.

16. The computer program product of claim 15, wherein the plurality of items comprise unit dose packages.

17. The computer program product of claim 15 further comprising an executable portion configured to cause the item to be presented to a user.

* * * * *